US005198331A

United States Patent [19]

Takiguchi et al.

[11] Patent Number: 5,198,331

[45] Date of Patent: Mar. 30, 1993

[54] SILVER HALIDE EMULSION CHEMICALLY RIPENED IN THE PRESENCE OF A GOLD-CONTAINING COMPLEX

[75] Inventors: Hideki Takiguchi; Tomoyuki Nakayama; Nobuaki Kagawa; Hakubun Ohashi, all of Hino, Japan

[73] Assignee: Konica Corporation, Tokyo, Japan

[21] Appl. No.: 725,186

[22] Filed: Jul. 3, 1991

[30] Foreign Application Priority Data

Jul. 9, 1990 [JP] Japan ..... 2-182194

[51] Int. Cl.[5] ..... G03C 1/005; G03C 1/09; G03C 1/34

[52] U.S. Cl. ..... 430/569; 430/600; 430/603; 430/605; 430/613; 430/614

[58] Field of Search ..... 430/605, 603, 600, 613, 430/614, 569

[56] References Cited

U.S. PATENT DOCUMENTS

| | | | |
|---|---|---|---|
| 4,720,451 | 1/1988 | Shuto et al. | 430/613 |
| 4,906,558 | 3/1990 | Mücke et al. | 430/600 |
| 4,952,490 | 8/1990 | Takada et al. | 430/605 |

OTHER PUBLICATIONS

Journal für Signalaufzeichnurgsmaterialien, vol. 5, No. 6, Nov. 1977, Berlin, DD, (pp. 449–455).

*Primary Examiner*—Charles L. Bowers, Jr.
*Assistant Examiner*—Mark F. Huff
*Attorney, Agent, or Firm*—Jordan B. Bierman

[57] ABSTRACT

A method for preparing a silver halide emulsion containing silver halide grains comprising (i) preparing a mixture by mixing a compound represented by the following Formula (1) or (2), and a gold compound; and (ii) performing chemical ripening of the emulsion by adding said mixture thereto:

Formula (1)

Formula (2)

wherein M, R, V and W independently represent a hydrogen atom or a substituent group; V and W may combine with each other to form a ring.

9 Claims, 2 Drawing Sheets

SILVER HALIDE EMULSION CHEMICALLY RIPENED IN THE PRESENCE OF A GOLD-CONTAINING COMPLEX

FIELD OF THE INVENTION

The present invention relates to a silver halide photographic light-sensitive material. More specifically, this invention relates to a technique improved in preventing increase in fog and accompanying deterioration in graininess when a high-speed light-sensitive material is preserved over a long period.

BACKGROUND OF THE INVENTION

Recently, there have been increasing demands for the silver halide photographic emulsion to have improved photographic properties such as high speed, good graininess, improved sharpness, low fog density and sufficiently high optical image density. These demands are seemingly different from one another, but most of them can be solved by a technique of manufacturing a high-speed and low-fog silver halide emulsion; therefore, it is no exaggeration to say that the technological development of a high-speed and low-fog silver halide emulsion is the largest task imposed on the industry.

Meanwhile, ultra-high speed color photographic light-sensitive materials with ISO speed of more than 1,000 have come to be marketed with the advance in sensitizing technique. This has brought about further problems of increasing fog due to natural radioactive rays (environmental radioactive rays and cosmic rays) and accompanying graininess deterioration, in addition to the conventionally known fogging attributable to heat and moisture in a long-term preservation. The problem is recognized in the industry as an important matter to be solved by all means in order to improve image quality of high-speed light-sensitive materials.

The fog increase and accompanying graininess deterioration caused in a long-term preservation of a high-speed silver halide light sensitive material are reported to be depending upon the amount of silver and gold, or the amount of potassium ions, contained in the light-sensitive material. As preventive measures against such deterioration, there are disclosed a technique to control coating weights of gold and silver per unit area of a light-sensitive material and the weight ratio thereof within specific limits in Japanese Patent O.P.I. Publication Nos. 96642/1989, 96651/1989 and 96652/1989, and as a measure to practice it, a method to remove free gold ions or free gold compounds which are present in places other than the inner portion or surface of silver halide grains. Further, Japanese Patent O.P.I. Publication No. 836/1990 discloses a technique to decrease the amount of potassium ions within a specific limit by replacing them by other ions. However, the amount disclosed in these patents are not necessarily new ones, these amounts are conventionally practiced in the industry; therefore, it is self-explanatory that these techniques are insufficient in solving the above problems. Moreover, those techniques to remove free gold ions or free gold compounds which are disclosed in these patents are considered to be not always advisable in view of the stability and cost in manufacturing. Under the circumstances, more effective measures have been strongly demanded.

The present inventors gave an eye to gold sensitizers, a prime factor of shelf-life deterioration of high-speed light-sensitive materials. In general, there have been used, as gold sensitizers (see U.S. Pat. No. 2,399,083, for example), inorganic gold complex salts such as chloroauric acid, potassium chloroaurate, potassium auriothiocyanate and auric trichloride. However, these salts have a disadvantage of releasing gold ions readily, and as a result a portion of the released gold ions forms a stabilized complex jointly with gelatin and remains in gelatin. Accordingly, deterioration in photographic properties caused by gold sensitizers can be tackled as a problem relating to the chemical properties of these gold sensitizers.

SUMMARY OF THE INVENTION

An object of the invention is to provide a high-speed silver halide photographic emulsion improved in storage stability with regard to photographic property deterioration such as fogging and lowering in graininess during storage after preparation.

The present inventors have made an intensive study and found that the object of the invention is attained by a silver halide photographic emulsion, which is characterized in that a mixed solution containing at least one of the compounds represented by the following Formula (1) or (2) and a gold compound is added in the manufacturing process of said silver halide emulsion.

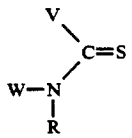

Formula (1)

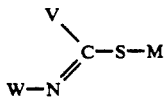

Formula (2)

wherein M, R, V and W independently represent a hydrogen atom or a substituent group; V and W may link with each other to form a ring.

DETAILED DESCRIPTION OF THE INVENTION

Figure 1:
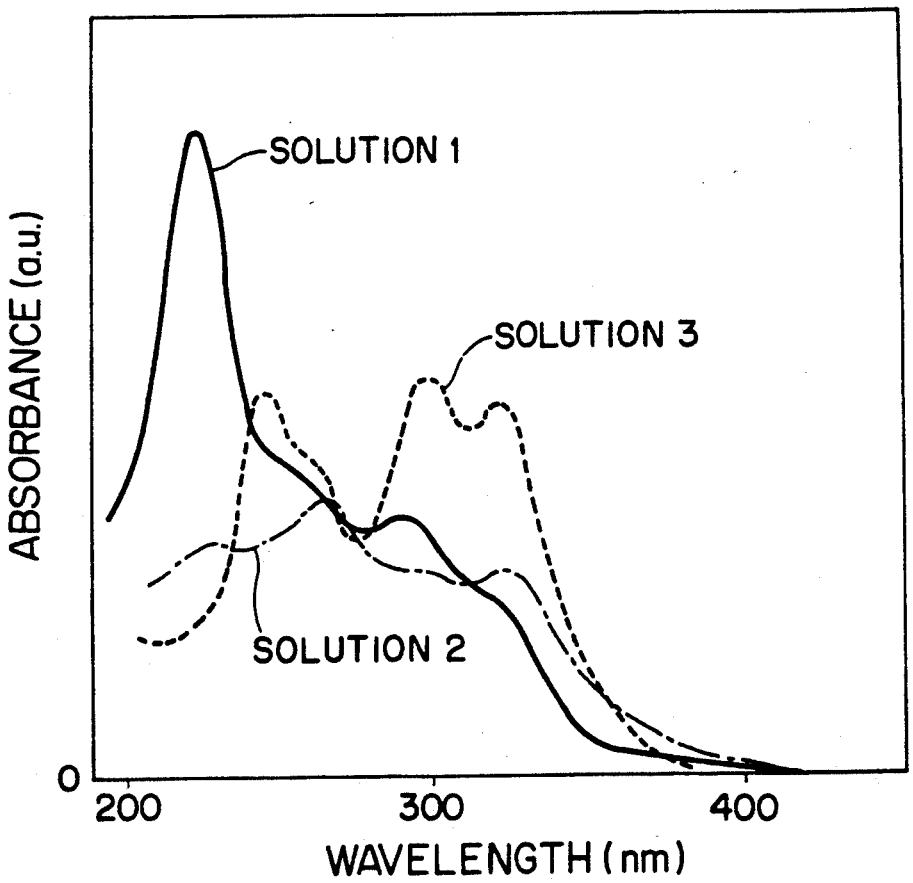
FIG. 1 shows ultra violet absorbing spectrum of a mixture solution of the compound in the present invention and the compound capable of supplying gold ion left for one hour after mixing.

Next, the present invention is described in detail.

In Formula (1) or (2), the substitutable group represented by R, V, W and M each represent a hydrogen atom, or an alkyl, alkenyl, aryl, heterocyclic, acylamino, alkylamino, ureido, amino, acyl or carboxylic group. V and W may link to form a heterocycle.

The alkyl group may be any of linear, branched and cyclic alkyl groups, but preferably substituted or unsubstituted alkyl groups having 1 to 8 carbon atoms. Examples thereof include methyl, ethyl, propyl, isopropyl, butyl, t-butyl, i-butyl, pentyl, cyclopentyl, hexyl, cyclohexyl, octyl and sulfoalkyl group.

The aralkyl group is, for example, a benzyl or phenethyl group; the alkenyl group is, for example, an allyl or 2-butenyl group; and the aryl group includes, for example, a phenyl and naphthyl group, each of which may have a substitutable group.

The heterocyclic group means a five- or six-membered heterocycle which contains at least one heteroatom selected from N, O and S; said heterocycle may be a condensed one and may have a substituent such as an alkyl group having 1 to 8 carbon atoms, phenyl group, hydroxyl group, or halogen atom (e.g. Br, Cl, F).

The acyl group is, for example, acyl or benzoyl group; the acylamino group contains, for example, acylamino or benzoylamino group; the ureido group is, for example, ureido, methylureido or phenylureido group.

When V and W link to form a heterocycle, said heterocycle is a five- or six-membered one such as thiazoline ring, thiazolone ring, thiazolium ring, pyrroline ring, pyrrolidone ring, pyrrolinium ring, imidazoline ring, imidazolone ring or imidazolium ring. Further, said heterocycle may have a substituent such as an alkyl group having 1 to 8 carbon atoms, phenyl group, hydroxyl group, or halogen atom (e.g. Br, Cl, F).

When R and M are hydrogen atoms, the compounds may have tautomerism.

Typical examples of the compound represented by Formula (1) or (2) are illustrated below, but useful examples are not limited to them.

(1-1)

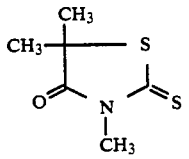

(1-2)

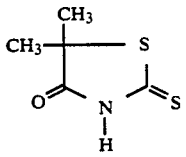

(1-3)

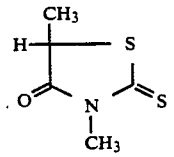

(1-4)

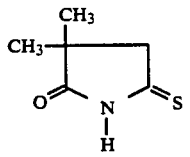

(1-5)

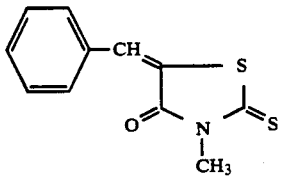

(1-6)

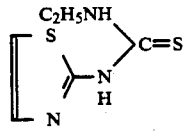

-continued (2-1)

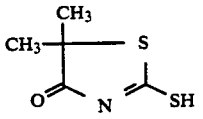

(2-2)

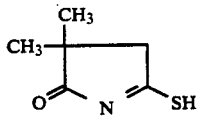

(2-3)

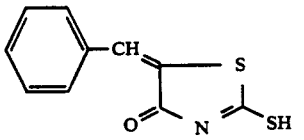

As a gold compound, which is a compound capable of supplying gold ions to the compound represented by Formula (1) or (2), there may be used a compound whose gold complex in said mixed solution has a thermodynamic stability larger than that of a complex salt formed between the compound represented by Formula (1) or (2) and a gold ion. Examples of such a compound are chloroauric acid, potassium chloroaurate, potassium auriothiocyanate and auric trichloride.

The mixed solution according to the invention may be prepared by dissolving individually at least one of the compounds represented by Formula (1) or (2) and the gold compound in a single or mixed solvent of water-miscible solvent such as methanol, ethanol or fluorinated alcohol and then mixing the solutions, or by dissolving first one of these two in a solvent and then adding thereto the other in the form of powder to dissolve.

For purposes of accelerating complexation of gold ions and preventing reduction of gold ions, the mixed solution may be adjusted to an appropriate pH with the addition of an acidic salt or alkali salt.

In the mixed solution, the molar concentration ratio of the compound represented by Formula (1) or (2) to the gold compound may be arbitrarily selected; but, in order to accelerate complexation of gold ions and to stabilize a formed gold complex, in which coordination number of gold ion is denoted by n, it is preferable that the molar concentration ratio be larger than n, namely, $$\frac{\text{Molar conc. of compound (1) or (2)}}{\text{Molar conc. of gold compound}} > n$$

The upper limit of this ratio is set to a level at which the compound (1) or (2) added to an emulsion does not impair photographic properties of a photographic light-sensitive material obtained using the emulsion.

In the mixed solution, the percentage of gold ions which have formed complexes together with the compound of (1) or (2) is generally more than 70%, and preferably more than 90% of the gold ions added to said mixed solution. In the particularly preferred case, more than 95% of gold ions have reacted to form complexes.

Whether or not the gold ions have formed complexes together with the compound of Formula (1) or (2) in the mixed solution can be known by the following means:

(1) To compare visible and ultraviolet absorption spectra of the mixed solution with those of solutions each dissolving the above compound singly.

(2) To compare infrared absorption spectra in a like manner. If the absorption of a solvent overlaps with those of the above compounds and obstructs the measurement, another appropriate solvent has to be selected.

(3) It is known that the bonding state of a specific atom (bond distance, coordination number) reflects upon the X-ray absorption spectrum of said atom. Using this property, the bonding state of a gold ion can be examined by determining the fine structure of an X-ray absorption spectrum (EXAFS).

Although these organic gold complexes can be formed and isolated in the form of crystals, these are generally unstable under conditions at which they are formed and isolated; therefore, synthesizing conditions with a high reproducibility are not always found. In other words, synthesis of these complexes cannot always meet the requirement to stably supply raw materials in the manufacture of photographic light-sensitive materials.

In addition to the above poor preservability as a raw material, these organic gold complexes occasionally generate reduced metal gold because of their instability, deteriorating photographic properties to a large extent.

However, use of the present invention can rectify the disadvantages mentioned above and bring out the best of these gold complexes.

Addition of the mixed solution of gold compounds according to the invention can be made at any time in the manufacturing process of an emulsion, but it is preferable to add it before the start or in the course of chemical ripening, or immediately before the completion of chemical ripening.

The addition amount of gold ions varies depending upon types of silver halide emulsions, types of compounds used and conditions of ripening, but it is preferably $1\times10^{-4}$ to $1\times10^{-8}$ mol, especially $1\times10^{-5}$ to $1\times10^{-8}$ mol per mol silver halides.

In chemical ripening according to the invention, there may be jointly used chemical sensitizers other than those specified above. Preferred ones are sulfur sensitizers.

Suitable sulfur sensitizers can be selected from sulfur crystal, water-soluble sulfide salts, thiosulfates, thioureas, mercapto compounds and rhodanines. Examples thereof can be seen in U.S. Pat. Nos. 1,574,944, 2,410,689, 2,278,947, 3,501,313, German Patent No. 1,422, 869 and Japanese Patent Examined Publication Nos. 20533/1974, 28568/1983. Among them, thiosulfates, thioureas and rhodanines are particularly preferred.

Other jointly usable chemical sensitizers in the invention include, for example, selenium compounds described in U.S. Pat. No. 3,420,670, 3,297,447 and Japanese Patent O.P.I Publication No. 71320/1975; reducing substances, such as amines and stannous salts, described in U.S. Pat. Nos. 2,487,850, 2,518,698, 2,521,925, 2,521,926, 2,419,973, 2,694,637, 2,983,610; and salts of precious metals, such as platinum, palladium, iridium and rhodium, described in U.S. Pat. Nos. 2,448,060, 2,566,245, 2,566,263.

The chemical ripening with the compounds of the invention can give favorable results when conducted in the presence of solvents for silver halides, such as thiocyanates, thioethers or 4-substituted thioureas.

The chemical ripening with the compounds of the invention can also be conducted in the presence of auxiliaries for chemical ripening (chemical ripening modifier) such as 4-hydroxy-6-methyl-1,3,3*a*,7-tetrazaindene, guanosin, sodium p-toluenesulfonate, and the like. Examples of such auxiliaries for chemical ripening are described in U.S. Pat. Nos. 2,131,038, 3,411,914, 3,554,757, Japanese Patent O.P.I. Publication No. 126526/1983 and on pages 138–143 of "Photographic Emulsion Chemistry" by G. F. Duffin, The Focal Press Co. (1966).

In the chemical ripening, the pAg (logarithm of a reciprocal of silver ion concentration) of the emulsion is preferably 7.0 to 11.0, the pH of the emulsion is preferably 4.0 to 9.0., and the temperature is preferably 40° to 90° C.

Use of the gold compound of the invention has an advantage of converting silver sulfide clusters, which are selectively formed and grown at specific sites on the surface of silver halide grains by slowly adding a sulfur sensitizer over a long time, into more useful gold-silver sulfide clusters. A technique for selective growing of silver sulfide clusters is disclosed in Japanese Patent O.P.I. Publication No. 93447/1986.

Silver halide photographic emulsions of the invention may have any silver halide composition such as silver bromide, silver iodobromide, silver iodochlorobromide or silver chlorobromide, and can be prepared by methods described, for example, in "Chimie et Physique Potographique" by P. Glafkides, Paul Montel Co. (1967); "Photographic Emulsion Chemistry" by G F. Duffin, The Focal Press Co. (1966); and "Making and Coating Photographic Emulsion" by V. L. Zelikman et al, The Focal Press Co. (1964). That is, there may be used any of the acid method, neutral method and ammoniacal method. As a method of reacting a soluble silver salt with a soluble halide, there may be used any of the single-jet mixing method, double-jet mixing method and combination thereof.

Further, a method to form grains in the presence of excessive silver ions (so-called reverse precipitation method) may be employed. As a version of the double-jet method, there may also be used a method to control the pAg of a liquid where a silver halide is formed, which is called the controlled double-jet method.

The silver halide grain size distribution of the photographic emulsion according to the invention may be monodispersed or polydispersed, either will do.

The silver halide grains contained in the silver halide emulsion of the invention may be any of regular crystals such as cubes, octahedrons and tetradecahedrons; irregular crystals such as spheres; and twin crystals or composites thereof. Further, the structure of the silver halide grains may have a substantially uniform composition, or a core/shell-type double- or multi-layered structure. For core/shell-type silver halide grains, it is preferable to have a silver halide composition different from inner portion (core portion) to outer portion (shell portion).

The gold compound of the invention is also applicable to sensitization of tabular silver halide grains. Here, tabular silver halide grains are those having a diameter/thickness ratio of 3 or more. The term "diameter" means a diameter equivalent to a circle having the same area as the silver halide grain; "thickness" is expressed by the distance between the two parallel planes which constitute the tabular silver halide grain.

The composition and structure of the tabular silver halide grains follow the above description of the composition and structure of silver halide grains.

In the silver halide crystals contained in the silver halide emulsion of the invention, host silver halide crystals may be joined with a silver halide of different composition by epitaxial growth, or may be joined with a compound other than silver halides such as silver thiocyanate or lead oxide.

During silver halide grain formation or physical ripening thereof, there may be allowed to coexist chalcogen compounds such as sulfur, selenium and tellurium; cadmium salts; zinc salts; lead salts; thallium salts; iridium salts or complex salts thereof; rhodium salts or complex salts thereof; and iron salts or complex salts thereof.

Reducing sensitization can also be applied to the inner portion of silver halide grains as described in Japanese Patent Examined Publication No. 1410/1983 and E. Moisar's paper in "Journal of Photographic Science", vol. 25 (1977), pp. 19–27.

In the invention, two or more types of silver halide emulsions prepared separately can be used together at an arbitrary mixing ratio.

The silver halide emulsions of the invention may be spectrally sensitized with methine dyes or the likes. Usable dyes are cyanine dyes, merocyanine dyes, complex cyanine dyes, complex merocyanine dyes, holopolarcyanine dyes, hemicyanine dyes, styryl dyes and hemioxonol dyes. Among them, the particularly preferred are cyanine dyes, merocyanine dyes and complex cyanine dyes.

These dyes may take any of basic heterocyclic nuclei generally used in cyanine dyes. Examples thereof include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus; and composite nuclei formed from these nuclei and an aliphatic hydrocarbon ring such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may be substituted on a carbon atom.

The merocyanine dyes and complex merocyanine dyes may have, as a ketomethylene structure nucleus, a five- or six-membered heterocyclic nucleus such as pyrazoline-5-one nucleus, thiohydantoin nucleus, 2-thioxazolidine-2,4-dione nucleus, rhodanine nucleus and thiobarbituric acid nucleus.

Useful sensitizing dyes can be seen, for example, in German Patent No. 929,080, U.S. Pat. Nos. 2,231,658, 2,493,748, 2,503,776, 2,519,001, 2,912,329, 3,655,394, 3,656,959, 3,672,897, 3,694,217, British Patent No. 1,242,588 and Japanese Patent Examined Publication No. 14030/1969.

These sensitizing dyes may be used singly or in combination. Combination of sensitizing dyes is frequently used, particularly for the purpose of supersensitization. Typical examples are described, for example, in U.S. Pat. Nos. 268,545, 2,977,229, 3,397,060, 3,522,052, 3,527,641, 3,617,293, 3,628,964, 3,666,480, 3,679,428, 3,703,377, 3,769,301, 3,814,609, 3,837,862, British Patent No. 1,344,281 and Japanese Patent Examined Publication No. 4936/1968.

The silver halide emulsion may use, in conjunction with the sensitizing dye, a supersensitizing substance which is a dye having no spectral sensitizing function or a substance substantially devoid of a visible-ray absorbing capability. For example, aminostyrene compounds substituted by a nitrogen-containing heterocyclic group (e.g., compounds described in U.S. Pat. Nos. 2,933,390, 3,935,721); formaldehyde condensates of aromatic organic acids (e.g., compounds described in U.S. Pat. No. 3,743,510); cadmium salts; and azaindene compounds can be used. Combinations described in U.S. Pat. Nos. 3,615,613, 3,615,641, 3,617,295 and 3,635,721 are particularly preferred.

In spectral sensitization of the silver halide emulsion of the invention, spectral sensitizing dyes may be added at any time before the start or in the course of chemical ripening, or after completion thereof, but better results can be obtained by the addition before chemical ripening.

For the purpose of improving sensitivity and contrast or accelerating development, the silver halide photographic emulsion of the invention may contain polyalkylene oxides or derivatives thereof such as ethers, esters or amines; thioether compounds; thiomorpholines; quaternary ammonium compounds; urethane derivatives; urea derivatives; imidazole derivatives; or 3-pyrazolidones. For example, there may be employed those compounds which are described in U.S. Pat. Nos. 2,400,532, 2,423,549, 2,716,062, 3,617,280, 3,772,021 and 3,808,003.

The silver halide emulsion of the invention may use antifoggants and stabilizers. Examples thereof can be seen in the paragraph "Antifoggants and Stabilizers" of Product Licensing Index, vol. 92, p. 107.

The silver halide emulsion of the invention may use conventional photographic additives.

Examples of the conventional photographic additives include, for example, compounds described in Research Disclosure Nos. 17643 (Dec. 1978) and 18716 (Nov. 1979).

| | RD-17643 | | RD-18716 |
|---|---|---|---|
| Additives | Page | Item | Page |
| Chemical sensitizers | 23 | III | 648 |
| Sensitizing dyes | 23 | IV | 648 |
| Developing accelerators | 29 | XXI | 648 |
| Antifoggants | 24 | VI | 649 |
| Stabilizers | 24 | VI | 649 |
| Antistain agents | 25 | VII | 650 |
| Image stabilizers | 25 | VII | |
| UV absorbents | 25 to 26 | VIII | 649 |
| Filter dyes | 25 to 26 | VIII | 649 |
| Whitening agents | 24 | V | |
| Hardeners | 26 | X | 651 |
| Coating aids | 26 to 27 | XI | 650 |
| Surfactants | 26 to 27 | XI | 650 |
| Plasticizers | 27 | XII | 650 |
| Slipping agents | 27 | XII | |
| Antistatic agents | 27 | XII | 650 |
| Matting agents | 28 | XVI | 650 |
| Binders | 26 | IX | 651 |

In a emulsion layer of the light-sensitive material according to the invention, there may be used dye forming couplers which form dyes, in developing process, by coupling reaction with an oxidation product of an aromatic primary amine developing agent (e.g., p-phenylenediamine derivative or aminophenol derivative).

In general, said dye forming couplers are selected so as to form dyes which absorb spectral rays to which respective emulsion layers are sensitive; therefore, yellow dye forming couplers are used in a blue-sensitive emulsion layer, magenta dye forming couplers in a green-sensitive emulsion layer, and cyan dye forming couplers in a red-sensitive emulsion layer. However, the above combination may be changed according to a specific requirement.

It is preferable that these dye forming couplers possess in their molecules a group containing 8 or more carbon atoms, called ballast group, to prevent the coupler from diffusing. These dye forming couplers may be either four-equivalent which needs 4 molecules of silver ion to be reduced to form 1 molecule of dye or two-equivalent which needs only 2 molecules of silver ion to be reduced. These dye forming couplers include colored couplers for color correction and compounds capable of forming, upon coupling with an oxidation product of a developing agent, a useful photographic fragment such as developing inhibitor, developing accelerator, bleaching accelerator, developer, silver halide solvent, color improver, fogging agent, antifoggant, chemical sensitizer, spectral sensitizer and desensitizer. Of them, couplers which release a developing inhibitor on development to improve sharpness and graininess of images are called DIR couplers. Instead of DIR couplers, there may also be used DIR compounds which release a developing inhibitor and colorless compound by coupling reaction with an oxidation product of a developing agent.

The DIR coupler and DIR compound includes ones in which an inhibitor bonds directly to a coupling position, and ones in which an inhibitor bonds to a coupling position via a divalent group and the inhibitor is released by means of intramolecular nucleophilic reaction or intramolecular electron-transfer reaction within the group released by coupling reaction (these are called timing DIR couplers and timing DIR compounds, respectively). The inhibitor thus released also falls into various types including diffusive one and less diffusive one, and these are used singly or in combination according to uses. Colorless couplers (or competitive couplers), which can react with an oxidation product of an aromatic primary amine developing agent but forms no dyes, may be used in combination with dye forming couplers.

As yellow dye forming couplers, conventional acylacetanilide type couplers are preferably used. Of them, benzoylacetanilide type and pivaloylacetanilide type are particularly preferred.

Examples of usable yellow dye forming couplers are those described, for example, in U.S. Pat. Nos. 2,875,057, 3,265,506, 3,408,194, 3,551,155, 3,582,322, 3,725,072, 3/891,445, German Patent No. 1,547,868, German Offenlegunschrift Nos. 2,219,917, 2,261,361, 2,414,006, British Patent No. 1,425,020, Japanese Patent Examined Publication No. 10783/1976 and Japanese Patent O.P.I. Publication Nos. 26133/1972, 73147/1973, 6341/1975, 87650/1975, 123342/1975, 130442/1975, 21827/1976, 102636/1976, 82424/1977, 115219/1977, 95346/1978.

As magenta dye forming couplers, there can be used conventional 5-pyrazolone type couplers, pyrazolobenzimidazole type couplers, pyrazolotriazole type couplers, open chain acylacetonitrile type couplers and indazolone type couplers.

Examples of usable magenta dye forming couplers are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, German Patent No. 1,810,464, German Offenlegunschrift Nos. 2,408,665, 2,417,945, 2,418,959, 2,424,467, Japanese Patent Examined Publication No. 6031/1975, Japanese Patent O.P.I. Publication Nos. 74027/1974, 74028/1974, 129538/1974, 60233/1975, 159336/1975, 20826/1976, 26541/1976, 42121/1977, 58922/1977, 55122/1988 and Japanese Patent Application No. 110943/1980.

As cyan dye forming couplers, there can be used conventional phenol type and naphthol type couplers including phenol type couplers which are substituted by an alkyl group, acylamino group or ureido group, naphthol type couplers having 5-aminonaphthol frame and two-equivalent naphthol type couplers having an oxygen atom as a releasable group.

Examples of usable cyan dye forming couples include those described, for example, in U.S. Pat. Nos. 2,895,826, 3,488,193, 3,779,763, Japanese Patent O.P.I. Publication Nos 52423/1978, 48237/1979, 27147/1981, 98731/1983, 185335/1985, 37557/1985, 225155/1985, 222853/1985, 2377448/1985, 3142/1986, 9652-3/1986, 39045/1986, 50136/1986, 99141/1986, 105545/1986 and Japanese Patent Examined Publication No. 11572/1974.

Photographic light-sensitive materials containing the silver halide emulsion of the invention are prepared by coating on a support high in smoothness and less in dimensional change during manufacturing and processing. Suitable supports are, for example, nitrocellulose film, cellulose ester film, polyvinylacetal film, polystyrene film, polyethylene terephthalate film, polycarbonate film, glass, paper, metal, and paper coated with polyolefin such as polyethylene or polypropylene. To improve adhesion to a photographic emulsion layer, these supports are subjected to various surface treatments such as hydropholic treatments. Such treatments include saponification treatment, corona treatment, subbing treatment and setting treatment.

Photographic light-sensitive materials containing the silver halide emulsion of the invention can be processed by a conventional photographic process with conventional processing solutions described, for example, in Research Disclosure No. 17643 (Dec. 1978), pp. 20–30.

This photographic process may be a black-and-white photographic process to obtain silver images or a color photographic process to obtain dye images. The temperature applied to the photographic process is normally 18° to 50° C., but temperatures lower than 18° C. or higher than 50° C. are also applicable.

Photographic light-sensitive materials containing the silver halide emulsion of the invention can be used as color or black-and-white light-sensitive materials in various forms. Examples include color light-sensitive materials such as color negative film for photographing, color reversal film, color photographic paper, color positive film, color reversal printing paper, and ones for the uses of direct positive, heat-developing and silver dye bleach; and black-and-white light-sensitive materials for the uses of X-ray photography, lith films, michrophotography, general photographing and black-and-white photographic paper.

The invention is particularly suitable for high-speed color light-sensitive materials, and in manufacturing multi-layered color light-sensitive materials, it is preferable to utilize various techniques such as ones to change the layer configuration for reconciling high speed and high image quality; ones to make up emulsion layers of the same spectral sensitivity into a three-layered structure for improved graininess; and ones to provide a reflective layer consisting of fine silver halide particles under a high-speed layer, particularly under a high-speed blue-sensitive layer, for the purpose of enhancing sensitivity. Of them, techniques on layer configuration are disclosed in U.S. Pat. Nos. 4,184,876, 4,129,446, 4,186,016, 4,186,011, 4,267,264, 4,173,479, 4,157,917, 4,165,236, British Patent Nos. 1,560,965, 2,137,372, 2,138,962, and Japanese Patent O.P.I. Publication Nos. 177552/1984, 180556/1984, 204038/1984. Techniques on reflective layers can be seen in Japanese Patent O.P.I. Publication No 160135/1984.

EXAMPLES

The present invention is hereunder described in detail with the examples, but the scope of the invention is not limited to these examples.

EXAMPLE 1

Preparation of Spherical Seed Emulsion

A monodispersed spherical seed grain emulsion was prepared from the following solutions $A_1$ to $D_1$ according to the method disclosed in Japanese Patent O.P.I. Publication No. 6643/1986.

| | | |
|---|---|---|
| $A_1$ | Ossein gelatin | 150 g |
| | Potassium bromide | 53.1 g |
| | Potassium iodide | 24 g |
| | Water to make | 7.2 l |
| $B_1$ | Silver nitrate | 1.5 kg |
| | Water to make | 6 l |
| $C_1$ | Potassium bromide | 1327 g |
| | 1-Phenyl-5-mercaptotetrazole (dissolved in methanol) | 0.3 g |
| | Water to make | 3 l |
| $D_1$ | Aqueous ammonia (28%) | 705 ml |

While stirring solution $A_1$ vigorously at 40° C., solutions $B_1$ and $C_1$ were added thereto by the double-jet method in 30 seconds to form nuclei. The pH was controlled to 1.09 to 1.15.

One minute and thirty seconds later, solution $D_1$ was poured in 20 seconds and the mixture was allowed to ripen for 5 minutes. During ripening, the KBr concentration was 0.071 mol/l, and the ammonia concentration was 0.63 mol/l.

Then, the pH was adjusted to 6.0, and desalination was conducted immediately after that. An electron-microscopic observation of the seed emulsion thus prepared proved that the emulsion was a monodispersed spherical one having an average grain size of 0.36 μm and distribution extent of 18%.

Preparation of Emulsion Em-A

Emulsion Em-A having an average silver iodide content of 8 0% was prepared by the following method using solutions described below.

| | | |
|---|---|---|
| $A_2$ | Ossein gelatin | 76.8 g |
| | Potassium bromide | 3.0 g |
| | | 24 g |
| | Disodium propyleneoxy-polyethyleneoxy disuccinate (10% methanol solution) | 10 ml |
| | Spherical seed emulsion (mentioned above) | equivalent to 0.91 mol |
| | Nitric acid (s.g. 1.38) | 4.5 ml |
| | Water to make | 4.0 l |
| $B_{2-1}$ | Silver nitrate | 137.2 g |
| | Nitric acid (s.g. 1.38) | 3.3 ml |
| | Water to make | 978 ml |

-continued

| | | |
|---|---|---|
| $C_{2-1}$ | Ossein gelatin | 39.1 g |
| | Potassium bromide | 62.4 g |
| | Potassium iodide | 46.8 g |
| | Water to make | 978 ml |
| $B_{2-2}$ | Silver nitrate | 137.7 g |
| | Nitric acid (s.g. 1.38) | 3.3 ml |
| | Water to make | 982 ml |
| $C_{2-2}$ | Ossein gelatin | 39.3 g |
| | Potassium bromide | 70.4 g |
| | Potassium iodide | 36.3 g |
| | Water to make | 982 ml |
| $B_{2-3}$ | Silver nitrate | 135.1 g |
| | Nitric acid (s.g. 1.38) | 1.4 ml |
| | Water to make | 397 ml |
| $C_{2-3}$ | Ossein gelatin | 15.8 g |
| | Potassium bromide | 75.6 g |
| | Potassium iodide | 26.4 g |
| | Water to make | 397 ml |
| $B_{2-4}$ | Silver nitrate | 758.4 g |
| | Nitric acid (s.g. 1.38) | 7.8 ml |
| | Water to make | 2,232 ml |
| $C_{2-4}$ | Ossein gelatin | 89.3 g |
| | Potassium bromide | 526 g |
| | Potassium iodide | 7.41 g |
| | Water to make | 2,232 ml |

The apparatus described in Japanese Patent O.P.I. Publication No. 160128/1987 was used. In preparing the emulsion, six pieces each of feeding nozzles arranged toward the lower portion of the stirring blades were appropriated for $B_2$ group solutions ($B_{2-1}$ to $B_{2-3}$, nozzles were changed over by solutions) and $C_2$ group solutions ($C_{2-1}$ to $C_{2-3}$, the same as the above), respectively. Thus, the apparatus was set to divide the feed of each solution into six portions.

While stirring solution $A_2$ at 450 rpm at 75° C., solutions $B_{2-1}$ and $C_{2-1}$ were added thereto by the double-jet method with flow rates of 11.62 ml/min at the start of addition and 22.91 ml/min at the end of addition. During the addition, the flow rate was increased in direct proportion to the addition time, the pAg was maintained at 8.3. After completion of the addition, the stirring rate was raised to 500 rpm.

Subsequently, solutions $B_{2-2}$ and $C_{2-2}$ were added thereto by the double-jet method so as to give flow rates of 22.91 ml/min at the start of addition and 30.27 ml/min at the end of addition. During the addition, the flow rate was increased linearly. The pAg was maintained at 8.3. After completing the addition of solutions $B_{2-2}$ and $C_{2-2}$, the pAg was adjusted to 8.6 with 3.5N potassium bromide aqueous solution.

Next, solutions $B_{2-3}$ and $C_{2-3}$ were added to the above solution under stirring by the double-jet method with flow rates of 16.71 ml/min at the start of addition and 18.63 ml/min at the end of addition. During the addition, the flow rate was increased in direct proportion to the addition time, and the pAg was maintained at 8.6. After completing the addition, the stirring rate was raised to 550 rpm.

While stirring the above solution, solutions $B_{2-4}$ and $C_{2-4}$ were added thereto by the double-jet method so as to give flow rates of 41.19 ml/min at the start of addition and 68.14 ml/min at the end of addition. During the addition, the flow rate was increased linearly to the addition time, and the pAg was maintained at 8.6.

After completing the addition, the pH was adjusted to 6.0 with an aqueous solution of potassium hydroxide (1.78N solution), and desalination was carried out by a conventional method. After that, 98 g of ossein gelatin was added thereto, and the total volume was then adjusted to 3,400 ml to obtain emulsion Em-A. The pAg and pH were finally adjusted to 8.0 and 6.0, respectively. An electron-microscopic observation of the resultant emulsion proved that the emulsion had an average grain size of 1.24 μm and variation coefficient of 13.9% and that the mean value of the ratio of diameter to thickness of the emulsion's twinned grains having even twin planes was 2.9.

Preparation of Mixed Solution of Gold Compounds

Figure 2:
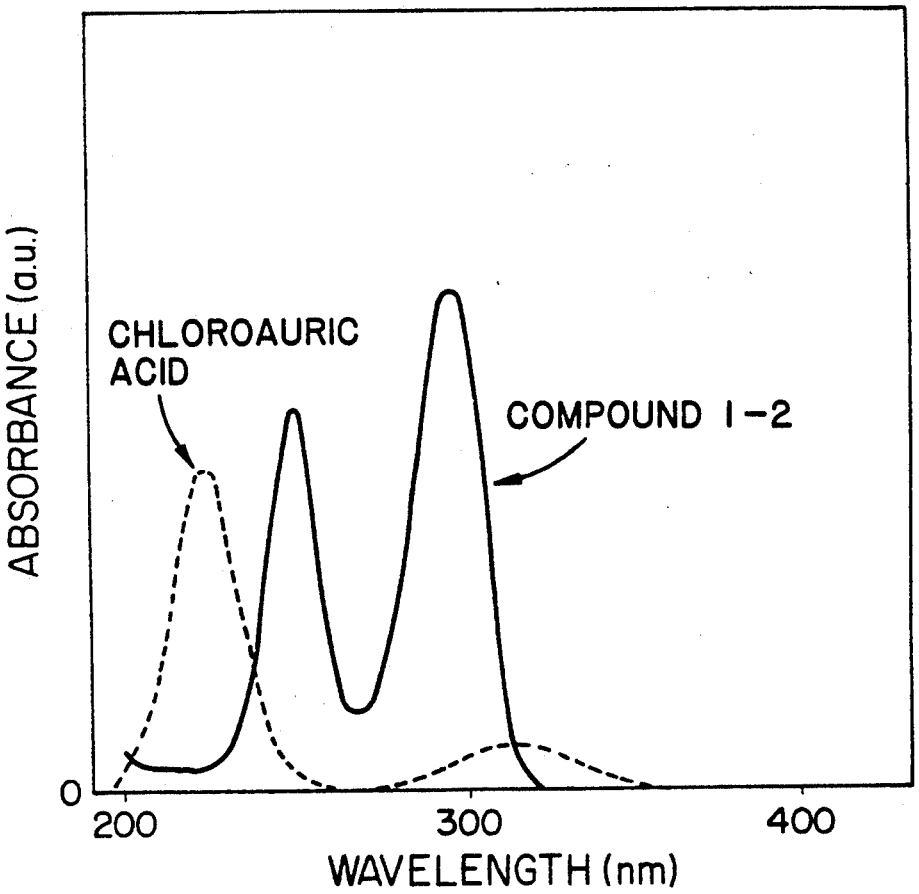
FIG. 2 shows ultra violet absorbing spectrum of auric acid chloride in fluorinated alcohol solvent and that of the compound 1-2 in the present invention.

Mixed solutions No. 1 to No. 3 were prepared by adding compound 1-2 and chloroauric acid in amounts shown in Table 1 to a fluoroalcohol solution. Mixed solution No.2 was adjusted to pH 7.0 with sodium carbonate immediately after the mixing. The reaction state of gold complexes was examined on each mixed solution from the ultraviolet absorption spectrum (see FIG. 1). One hour after the mixing, more than 40% of the chloroauric acid remained unreacted in mixed solution No. 1. For mixed solution Nos. 2 and 3, however, it was estimated that more than 90% of the chloroauric acid reacted to form new gold complexes. It is clearly understood from the comparison of FIG. 1 with FIG. 2 that reaction products other than compound 1-2 and chloroauric acid (FIG. 2) were formed in the mixed solutions.

Preparation of Coated Samples

Emulsion Em-A was divided into portions, and to each portion were added at 55° C., per mol silver halide contained therein, $2\times10^{-4}$ mol of potassium thiocyanate, $1.2\times10^{-4}$ mol of the following sensitizing dye SD-6, $1.0\times10^{-4}$ mol of the dye SD-7, $3.4\times10^{-6}$ mol of the dye SD-8, $2.1\times10^{-5}$ mol of the dye SD-4 and $4.2\times10^{-6}$ mol of sodium thiosulfate. Subsequently, there were further added $1\times10^{-6}$ mol each of the aforesaid solutions No. 1 to No. 3 and the gold compound (the amount was in terms of gold ions) and compound 1-2 ($1\times10^{-6}$ mol) shown in Table 2, then, the temperature was reduced to 40° C. over a period of time which optimized the relation between fogging and sensitivity, and 900 mg per mol silver halide of 4-hydroxy-6-methyl-1,3,3*a*,7-tetrazaindene was added as a stabilizer to obtain emulsion Em-A.

Next, there were added a coupler dispersion of the following composition in an amount specified below and an appropriate amount of sodium 2-hydroxy-4,6-dichlorotriazine. Then, the coating solution prepared was coated and dried on a subbed cellulose triacetate support to a silver coating weight of 2.0 g/m². Samples 1 to 5 were thus obtained, of which contents are shown in Table 2.

Mixed solutions No. 1 to No. 3 were added after 1 hour from the preparation.

| Coupler dispersion | Addition amount/ mol AgX |
|---|---|
| 1-(2,4,6-trichlorophenyl)-3-[3-(2,4-di-t-amino phenoxyacetoamidobenzamido]-5-pyrazolone | 80 g |
| 1-(2,4,6-trichlorophenyl)-4-(1-naphthyl-azo)-3-(2-chloro-5-octadecenylsuccinimido-anilino)-5-pyrazolone | 2.5 g |
| Tricresyl phosphate | 120 g |
| Ethyl acetate | 240 ml |
| Sodium triisopropyl naphthalenesulfonate | 5 g |
| Ossein gelatin | 41.25 g |
| Water was added to make | 550 ml |

One portion of the sample prepared as above was allowed to stand for 1 day in atmospheric conditions.

Another portion was subjected to forced deterioration by being kept for 6 days in an environment of 55° C. and 20% RH. The third portion was irradiated to 200 mR by γ-rays from $^{60}$Co, in order to utilize as a sample to examine the influence of natural radioactive rays. These samples were wedge-exposed to green light, processed according to the following photographic process for color light-sensitive materials, and then evaluated for the photographic property.

The evaluation results are shown in Table 2, where the sensitivity is given by a reciprocal of the exposure which gives an optical density of fog +0.3 and shown as a value relative to the sensitivity of sample 1 undergone standing under atmospheric conditions, which is set at 100.

| Process (Processing temp. 38° C.) | Processing time |
|---|---|
| Color developing | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |
| Drying | |

The composition of a processing solution used in each process is as follows:

| | |
|---|---|
| (Color developer) | |
| 4-Amino-3-methyl-N-ethyl-N-β-hydroxy-ethylaniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water was added to make 1 liter, and the pH was adjusted to 10.6 with sodium hydroxide. | |
| (Bleacher) | |
| Ammonium ferric ethylenediamine tetracetate | 100.0 g |
| Diammonium ethylenediamine tetracetate | 10.0 g |
| Ammonium bromide | 150.0 g |
| Glacial acetic acid | 10.0 g |
| Water was added to make 1 liter, the pH was adjusted to 6.0 with aqueous ammonia. | |
| (Fixer) | |
| Ammonium thiosulfate | 175.0 g |
| Anhydrous sodium sulfite | 8.6 g |
| Sodium metasulfite | 2.3 g |
| Water was added to make 1 liter, the pH was adjusted to 6.0 with acetic acid. | |
| (Stabilizer) | |
| Formalin (37% aqueous solution) | 1.5 ml |
| Konidax (product of Konica Corp.) | 7.5 ml |
| Water was added to make 1 liter. | |

TABLE 1

| Mixed solution | Compound 1-2 (mol/l) | Chloroauric acid (mol/l) | pH | Unreacted chloroauric acid |
|---|---|---|---|---|
| 1 | $6.5\times10^{-6}$ | $6.5\times10^{-6}$ | 4.80 | 40% or more |
| 2 | $6.5\times10^{-6}$ | $6.5\times10^{-6}$ | 7.00 | 10% or less |
| 3 | $19.5\times10^{-6}$ | $6.5\times10^{-6}$ | 4.80 | 10% or less |

TABLE 2

| Sample No. | Emulsion | Gold sensitizer | 1-day aging Fog | 1-day aging Sensitivity | 6-day aging Fog | 6-day aging Sensitivity | γ-ray irradiated Fog | γ-ray irradiated Sensitivity |
|---|---|---|---|---|---|---|---|---|
| 1 (Comp.) | B | Comparative compound-1 | 0.17 | 100 | 0.30 | 90 | 0.30 | 90 |
| 2 (Comp.) | C | Comparative compound-2 | 0.16 | 95 | 0.28 | 85 | 0.28 | 83 |
| 3 (Comp.) | D | Compound 1-2* | 0.10 | 10 | — | — | — | — |
| 4 (Inv.) | E | Solution No. 1 | 0.17 | 100 | 0.27 | 92 | 0.26 | 95 |
| 5 (Inv.) | F | Solution No. 2 | 0.19 | 98 | 0.27 | 90 | 0.24 | 95 |
| 6 (Inv.) | G | Solution No. 3 | 0.16 | 106 | 0.24 | 100 | 0.23 | 102 |

*Compound 1-2 is shown for comparison and contains no gold ions.
Comparative compound-1: $HAuCl_4.4H_2O$
Comparative compound-2: $Na_3[Au(S_2O_3)_2]$ As apparent from Table 2, samples 3 to 6 using a solution of the invention are stable to heat and natural radioactive rays such as γ-rays as compared with samples 1 and 2 using comparative compounds.

It is also apparent that when the content of gold ions which formed complexes with compound 1-2 is increased fog by γ-ray irradiation can be effectively reduced, and that compound 1-2 itself has no sensitizing capability in contrast to the mixed solution.

EXAMPLE 2

Emulsion Em-A was divided into portions. To each portion were added, per mol silver halide contained therein, $1.8\times10^{-4}$ mol of spectral sensitizing dye SD-9, $7.9\times10^{-5}$ mol of the dye SD-10, and further $1.5\times10^{-4}$ mol of ammonium thiocyanate, $5.2\times10^{-6}$ mol of sodium thiosulfate, and $1.4\times10^{-6}$ mol of the gold sensitizer shown in Table 3 Then, each emulsion was optimumly sensitized at 52° C.

After that the stabilizer was added thereto

Emulsions

Em-H to Em-L were thus prepared. Mixed solutions No. 1 to No. 3 were prepared 1 hour before the addition.

The following multi layered color photographic light-sensitive materials 101 to 105 were prepared by employing emulsions Em-H to Em-L in the high-speed bule-sensitive layer and emulsion Em-G described in Example 1 in the high-speed green-sensitive layer.

In the following layer compositions, the addition amount is g per square meter, unless otherwise specified. The amount of silver halide and colloidal silver is given in silver equivalent, and the amount of a sensitizing dye is per mol silver halide.

| | |
|---|---|
| 1st layer: antihalation layer (HC-1) | |
| Black colloidal silver | 0.81 |
| UV absorbent (UV-1) | 0.23 |
| High boiling solvent (Oil-1) | 0.18 |
| Gelatin | 1.42 |
| 2nd layer: 1st intermediate layer (IL-1) | |
| Gelatin | 1.27 |
| 3rd layer: low-speed red-sensitive emulsion layer (RL) | |
| Octahedral monodispersed silver iodobromide emulsion (average grain size: 0.45 μm, average silver iodide content: 8.2 mol %) | 0.78 |
| Sensitizing dye (SD-1) | $1.8\times10^{-5}$ |
| Sensitizing dye (SD-2) | $2.8\times10^{-4}$ |
| Sensitizing dye (SD-3) | $3.0\times10^{-4}$ |
| Sensitizing dye (SD-4) | $4.1\times10^{-4}$ |
| Cyan coupler (C-1) | 0.70 |
| Colored cyan coupler (CC-1) | 0.066 |
| DIR compound (D-1) | 0.028 |
| High boiling solvent (Oil-1) | 0.64 |

-continued

| | |
|---|---|
| Gelatin | 1.18 |
| 4th layer: medium-speed red-sensitive emulsion layer (RM) | |
| Octahedral monodispersed silver iodobromide emulsion (average grain size: 0.81 μm, average silver iodide content: 9.1 mol %) | 0.78 |
| Sensitizing dye (SD-1) | $2.1\times10^{-5}$ |
| Sensitizing dye (SD-2) | $1.9\times10^{-4}$ |
| Sensitizing dye (SD-3) | $9.6\times10^{-5}$ |
| Sensitizing dye (SD-4) | $9.6\times10^{-5}$ |
| Cyan coupler (C-1) | 0.28 |
| Colored cyan coupler (CC-1) | 0.027 |
| DIR compound (D-1) | 0.011 |
| High boiling solvent (Oil-1) | 0.26 |
| Gelatin | 1.58 |
| 5th layer: high-speed red-sensitive | emulsion layer (RH) |
| Monodispersed silver iodobromide emulsion (average grain size: 0.99 μm, average silver iodide content: 8.0 mol %) | 1.73 |
| Sensitizing dye (SD-1) | $1.9\times10^{-5}$ |
| Sensitizing dye (SD-2) | $1.7\times10^{-4}$ |
| Sensitizing dye (SD-3) | $1.7\times10^{-4}$ |
| Cyan coupler (C-2) | 0.14 |
| DIR compound (D-1) | 0.025 |
| High boiling solvent (Oil-1) | 0.17 |
| Gelatin | 1.24 |
| 6th layer: 2nd intermediate layer (IL-2) | |
| Gelatin | 0.80 |
| 7th layer: low-speed green-sensitive emulsion layer (GL) | |
| Octahedral monodispersed silver iodobromide emulsion (average grain size: 0.45 μm, average silver iodide content: 8.2 mol %) | 0.98 |
| Sensitizing dye (SD-4) | $6.8\times10^{-5}$ |
| Sensitizing dye (SD-5) | $6.2\times10^{-4}$ |
| Magenta coupler (M-1) | 0.54 |
| Magenta coupler (M-2) | 0.19 |
| Colored magenta coupler (CM-1) | 0.06 |
| DIR compound (D-2) | 0.017 |
| High boiling solvent (Oil-2) | 0.81 |
| Gelatin | 1.77 |
| 8th layer: medium-speed green-sensitive emulsion layer (GM) | |
| Octahedral monodispersed silver iodobromide emulsion (average grain size: 0.81 μm, average silver iodide content: 9.1 mol %) | 0.66 |
| Sensitizing dye (SD-6) | $1.9\times10^{-4}$ |
| Sensitizing dye (SD-7) | $1.2\times10^{-4}$ |
| Sensitizing dye (SD-8) | $1.5\times10^{-5}$ |
| Sensitizing dye (SD-4) | $8.2\times10^{-5}$ |
| Magenta coupler (M-1) | 0.074 |
| Magenta coupler (M-2) | 0.034 |
| Colored magenta coupler (CM-1) | 0.043 |
| DIR compound (D-2) | 0.018 |
| High boiling solvent (Oil-2) | 0.30 |
| Gelatin | 0.76 |
| 9th layer: high-speed green-sensitive emulsion layer (GH) | |
| Emulsion Em-G (described in Example 1) | 1.65 |
| Magenta coupler (M-1) | 0.094 |
| Magenta coupler (M-3) | 0.044 |
| Colored magenta coupler (CM-1) | 0.038 |

-continued

| | |
|---|---|
| High boiling solvent (Oil-2) | 0.31 |
| Gelatin | 1.23 |
| 10th layer: yellow filter layer (YC) | |
| Yellow colloidal silver | 0.05 |
| Antistain agent (SC-1) | 0.1 |
| High boiling solvent (Oil-2) | 0.125 |
| Gelatin | 1.33 |
| Formalin scavenger (HS-1) | 0.088 |
| Formalin scavenger (HS-2) | 0.066 |
| 11th layer: low-speed blue-sensitive emulsion layer (BL) | |
| Octahedral monodispersed silver iodobromide emulsion (average grain size: 0.45 μm, average silver iodide content: 8.2 mol %) | 0.25 |
| Octahedral monodispersed silver iodobromide emulsion (average grian size: 0.81 μm, average silver iodide content: 9.1 mol %) | 0.12 |
| Sensitizing dye (SD-9) | $5.2 \times 10^{-4}$ |
| Sensitizing dye (SD-10) | $1.9 \times 10^{-5}$ |
| Yellow coupler (Y-1) | 0.65 |
| Yellow coupler (Y-2) | 0.24 |
| High boiling solvent (Oil-2) | 0.18 |
| Gelatin | 1.25 |
| Formalin scavenger (HS-1) | 0.08 |
| 12th layer: high-speed blue-sensitive emulsion layer (BH) | |
| Emulsion (described in Table 3) | 1.80 |
| Yellow coupler (Y-1) | 0.18 |

-continued

| | |
|---|---|
| High boiling solvent (Oil-2) | 0.074 |
| Gelatin | 1.30 |
| Formalin scavenger (HS-1) | 0.05 |
| Formalin scavenger (HS-2) | 0.12 |
| 13th layer: 1st protective layer (Pro-1) | |
| Fine grain silver iodobromide emulsion (average grain size: 0.08 μm, AgI content: 1 mol %) | 0.4 |
| UV absorbent (UV-1) | 0.07 |
| UV absorbent (UV-2) | 0.10 |
| High boiling solvent (Oil-1) | 0.07 |
| High boiling solvent (Oil-3) | 0.07 |
| Formalin scavenger (HS-1) | 0.13 |
| Formalin scavenger (HS-2) | 0.37 |
| Gelatin | 1.3 |
| 14th layer: 2nd protective layer (Pro-2) | |
| Alkali-soluble matting agent (average particle size: 2 μm) | 0.13 |
| Polymethylmethacrylate (average particle size: 3 μm) | 0.02 |
| Slipping agent (WAX-1) | 0.04 |
| Gelatin | 0.6 |

Besides the above compounds, there were added coating aid Su-1, dispersing aid Su-2, viscosity regulating agent, hardeners H-1 and H-2, stabilizer ST-1 and antifoggants Af-1 (Mw: 10,000) and AF-2 (Mw: 1,100,000).

C-1

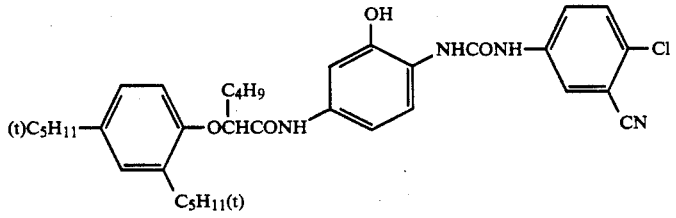

C-2

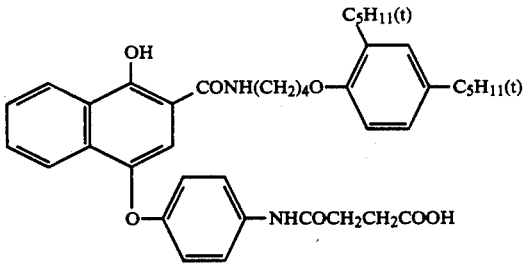

M-1

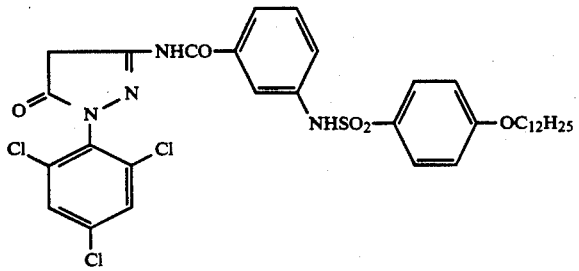

-continued
M-2
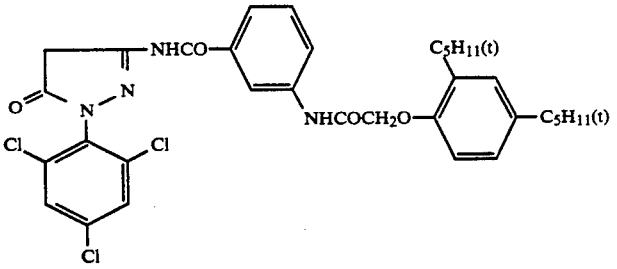
M-3
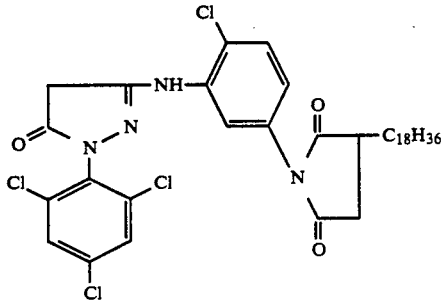
Y-1
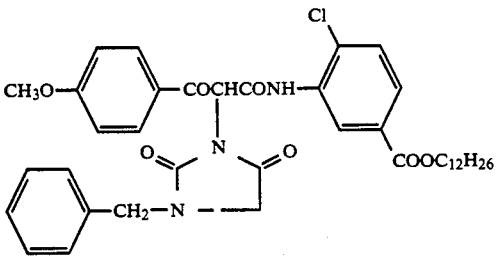
Y-2
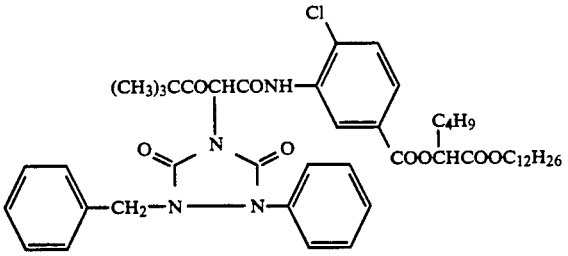
CC-1
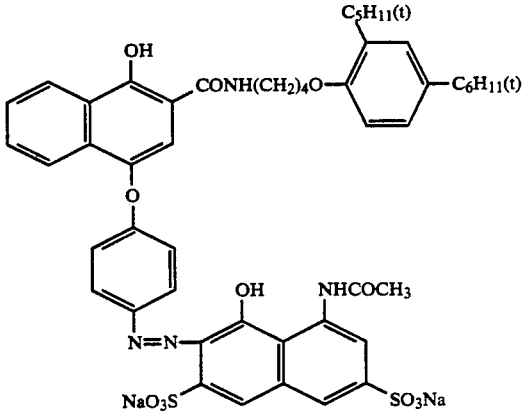

-continued
CM-1
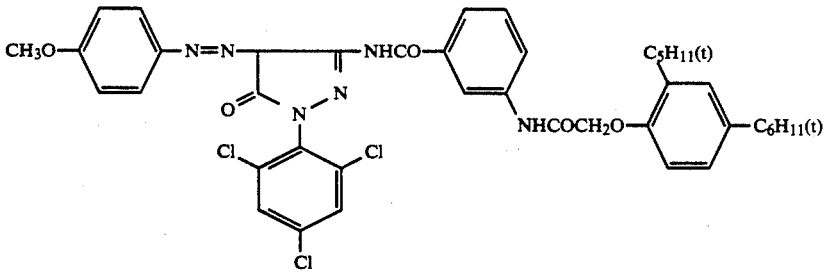
D-1
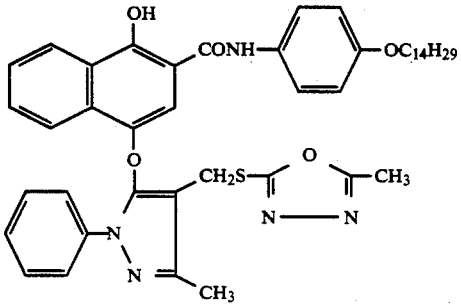
D-2
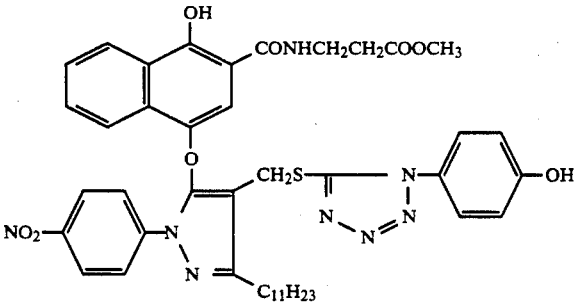
Oil-1
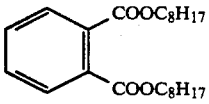
Oil-2
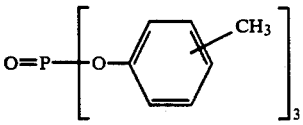
Oil-3
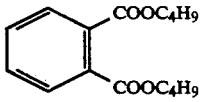
SC-1
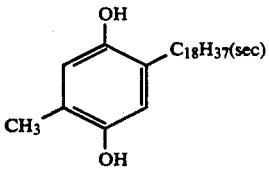
UV-1
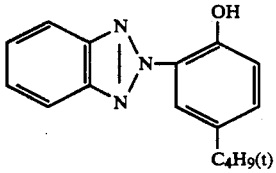

-continued
UV-2
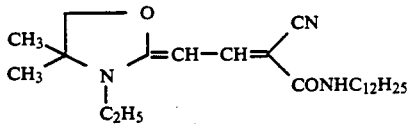
WAX-1
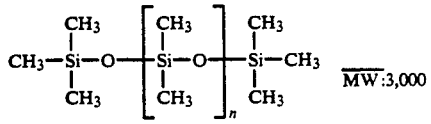
Su-1
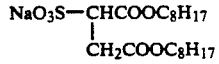
Su-2
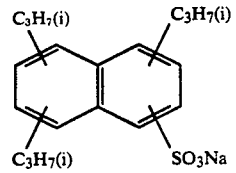
HS-1
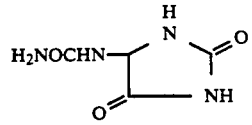
HS-2
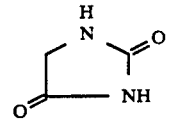
SD-1
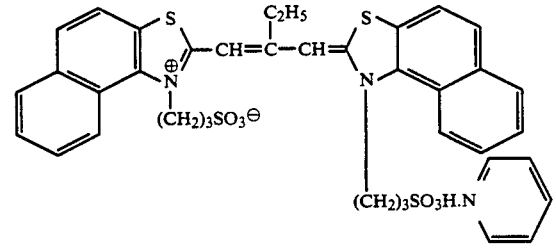
SD-2
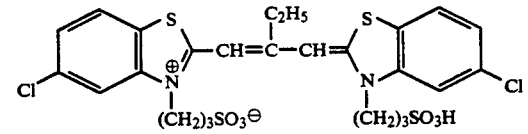
SD-3
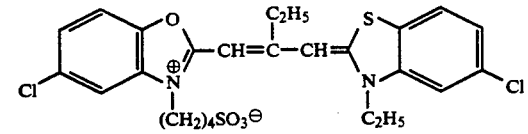
SD-4
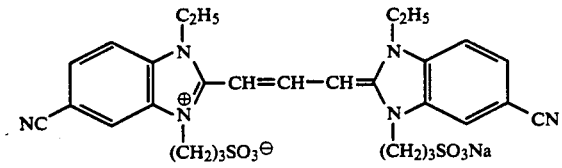

-continued
SD-5
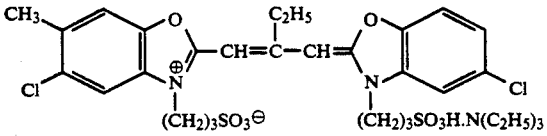
SD-6
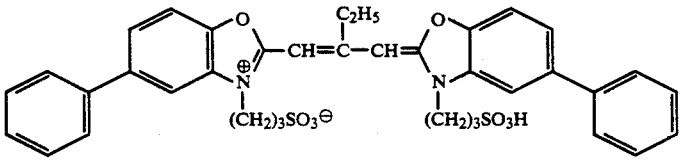
SD-7
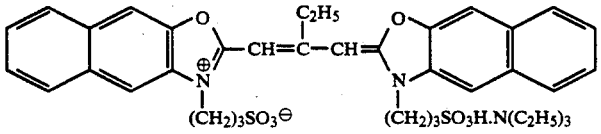
SD-8
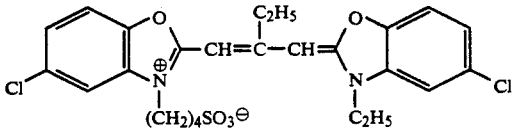
SD-9
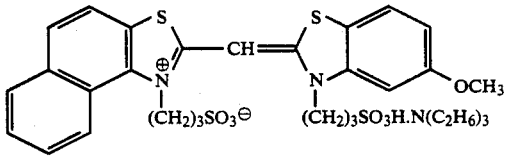
SD-10
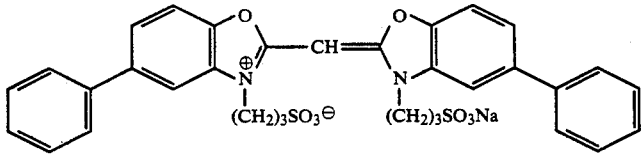
H-1
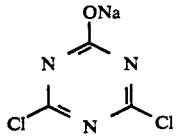
$(CH_2{=}CHSO_2CH_2)_2O$ H-2
ST-1
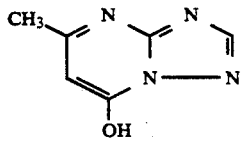
AF-1
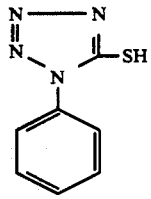

-continued

AF-2

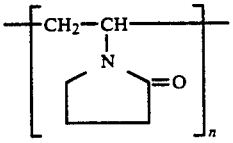

Similarly to Example 1, the samples preserved or exposed to radiation were subjected to exposure (blue light) through an optical wedge in a conventional method, and then were color-developed according to the above-mentioned color processing steps for evaluation of photographic fog and sensitivity. The results are shown in Table 3.

In the Table, both fog and sensitivity are on the basis of yellow density, and the sensitivity indicates the relative sensitivity that is based on the inverse number of exposure amount giving optical density of (fog density +0.3) and is relative to 100 which is the sensitivity of Sample 101 subjected to natural aging for one day.

TABLE 3

| | High-speed blue sensitive layer | | Natural aging for 1 day | | γ rays radiation (200 mR) | |
|---|---|---|---|---|---|---|
| Sample No. | Emulsion | Auric sensitizer | Fog | Sensitivity | Fog | Sensitivity |
| 101 (Comp.) | H | Comparative compound-1 | 0.64 | 100 | 0.85 | 85 |
| 102 (Comp.) | I | Comparative compound-2 | 0.64 | 90 | 0.86 | 70 |
| 103 (Inv.) | J | Mixed solution No. 1 | 0.63 | 98 | 0.82 | 79 |
| 104 (Inv.) | K | Mixed solution No. 2 | 0.66 | 100 | 0.82 | 88 |
| 105 (Inv.) | L | Mixed solution No. 3 | 0.63 | 105 | 0.81 | 95 |

As is apparent from Table 3, in case of Samples 103 to 105 employing the additive liquid (solution) of the present invention, deterioration of performance (increase of fog) caused by γ ray radiation, that is, by natural radiation was comparatively slight, which showed excellent characteristics in terms of preservability of a high-speed photographic light-sensitive material.

EXAMPLE 3

Gold compound A was prepared from exemplified compound 1-2 and chloroauric acid by the following procedure.

There was dissolved 12.8 g of 5,5-dimethyl-rhodanine in 4 liters of methanol, and then water was added to make the total volume 8 liters. After cooling to 15° C., a solution of chloroauric acid was added in an amount equivalent to the 5,5-dimethyl-rhodanine. The precipitation formed was recovered by suction filtration, purified and then dried to powder. (When added to an emulsion, it was dissolved in fluoroalcohol).

Gold compound A prepared as above was divided into two portions; then, one portion was stored for 7 days at 25° C. and 30% RH, and the other was subjected to forced deterioration for the same period at 50° C. and 30% RH. Influences on photographic properties were examined on both cases. In a similar manner, compound 1-2 was subjected to forced deterioration; using this, a mixed solution was prepared by the method used with mixed solution No.2 in Example 2 to examine photographic properties.

Coated samples 7 to 10 shown in Table 4 were prepared using emulsion Em-A subjected to chemical sensitization. The samples were processed in the same manner as in Example 1. The evaluation results for sensitivity and fog after 1-day standing in atmospheric conditions are shown in Table 4, where the sensitivity is given by a valve relative to the sensitivity of sample 9 which is set at 100.

TABLE 4

| Sample No. | Gold sensitizer | Fog | Sensitivity |
|---|---|---|---|
| 7 (Comp.) | Compound A stored at 25° C. | 0.21 | 103 |
| 8 (Comp.) | Compound A stored at 50° C. | 0.27 | 89 |
| 9 (Inv.) | Mixed solution No. 2 | 0.19 | 100 |
| 10 (Inv.) | Mixed solution No. 2 (prepared using compound 1-2 stored at 50° C.) | 0.19 | 98 |

As apparent from Table 4, gold compound A formed, from compound 1-2 and chloroauric acid and extracted into powder, is substantially deteriorated in storage, but the method according to the invention does not cause such problems.

What is claimed is:

1. A method for preparing a silver halide emulsion containing silver halide grains comprising (i) preparing a solution by mixing a compound represented by the following Formula (1) or (2), and a gold compound with a solvent; and (ii) performing chemical ripening of the emulsion by adding said solution thereto:

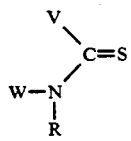

Formula (1)

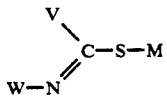

Formula (2)

wherein M, R, V and W independently represent a hydrogen atom or a substituent group; V and W may combine with each other to form a ring.

2. The method of claim 1, wherein in Formula (1) or (2), M, R, V and W independently represent a hydrogen atom, or an alkyl, alkenyl, aryl, heterocyclic, acylamino, alkylamino, ureido, amino, acyl or carboxylic group; V and W may combine with each other to form a heterocyclic ring.

3. The method of claim 1, wherein said compound represented by Formula (1) or (2) is a compound selected from compounds having the formulae:

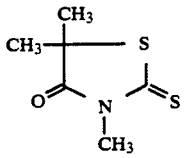

-continued

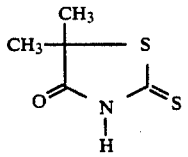

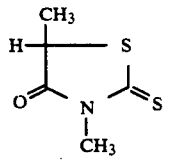

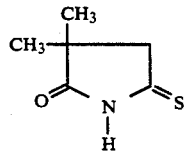

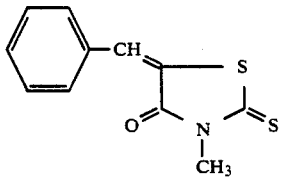

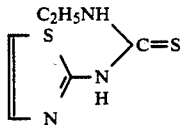

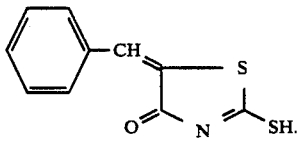

4. The method of claim 1, wherein said gold compound is a compound selected from chloroauric acid, chloroaurates, auriothiocyanates and auric trichloride.

5. The method of claim 1, wherein in (i), said gold compound is so mixed that more than 70% of said gold compound added will form a complex with said compound of Formula (1) or (2) in said solution.

6. The method of claim 5, wherein the percentage is more than 90%.

7. The method of claim 1, wherein in (ii), an addition amount of gold is within a range of $1\times10^{-4}$ to $1\times10^{-8}$ mol per mol of silver halide.

8. The method of claim 1, wherein in (ii), the chemical ripening is performed further by adding a sulfur sensitizer selected from thisulfates, thiureas and rhodanines.

9. A method for preparing a silver halide emulsion containing silver halide grains comprising (i) preparing a solution by mixing a sulfur containing compound and a gold compound with a solvent; and (ii) performing chemical ripening of the emulsion by adding said solution thereto;

wherein said sulfur containing compound is a compound selected from compounds having the formulae:

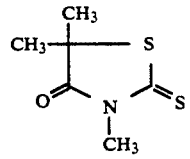

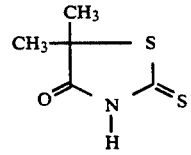

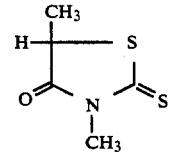

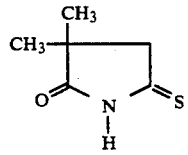

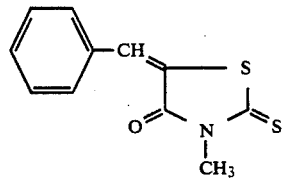

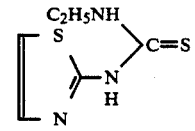

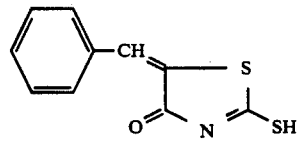

and said gold compound is a compound selected from chloroauric acid, chloroaurates, auriothiocyanates and auric trichloride.

* * * * *